US010392817B2

(12) United States Patent
Gross et al.

(10) Patent No.: US 10,392,817 B2
(45) Date of Patent: Aug. 27, 2019

(54) PANEL INSTALLATION APPARTUS

(71) Applicant: Ruwka Inc., London (CA)

(72) Inventors: Jakob Petr Gross, London (CA); Ante Brkic, London (CA)

(73) Assignee: RUWKA INC., London (CA)

( * ) Notice: Subject to any disclaimer, the term of this patent is extended or adjusted under 35 U.S.C. 154(b) by 0 days.

(21) Appl. No.: 16/050,997

(22) Filed: Jul. 31, 2018

(65) Prior Publication Data

US 2019/0055739 A1 Feb. 21, 2019

Related U.S. Application Data

(60) Provisional application No. 62/545,961, filed on Aug. 15, 2017.

(51) Int. Cl.

| | |
|---|---|
| ***E04F 21/18*** | (2006.01) |
| ***B25G 1/04*** | (2006.01) |
| ***B25H 3/04*** | (2006.01) |
| ***B25B 11/00*** | (2006.01) |
| *B25B 23/08* | (2006.01) |
| *B25B 23/18* | (2006.01) |

(52) U.S. Cl.

CPC ..... *E04F 21/18* (2013.01); *B25B 11/00* (2013.01); *B25G 1/04* (2013.01); *B25H 3/04* (2013.01); *B25B 23/08* (2013.01); *B25B 23/18* (2013.01)

(58) Field of Classification Search

CPC . E04F 21/18; B25B 23/08; B25G 1/04; A47F 7/0028; B65D 85/24

USPC ..... 414/10–12; 206/338, 341; 211/69; 294/25, 29, 901

See application file for complete search history.

(56) References Cited

U.S. PATENT DOCUMENTS

| | | | | |
|---|---|---|---|---|
| 1,229,976 | A | 6/1917 | Klais | |
| 2,672,319 | A * | 3/1954 | Nelson | B66F 11/04 182/141 |
| 3,828,942 | A * | 8/1974 | Young | B66B 9/16 254/4 R |
| 4,576,354 | A | 3/1986 | Blessing | |
| 4,695,028 | A * | 9/1987 | Hunter | E04F 21/1805 248/354.1 |
| 4,867,403 | A | 9/1989 | Anderson | |
| 4,928,916 | A | 5/1990 | Molloy | |
| 5,129,774 | A * | 7/1992 | Balseiro | E04F 21/1805 248/354.1 |
| 5,213,240 | A * | 5/1993 | Dietz | A45F 5/02 224/183 |
| 5,326,068 | A * | 7/1994 | Spears | B25B 15/00 211/60.1 |
| 5,640,826 | A * | 6/1997 | Hurilla, Jr. | E04F 21/1805 414/11 |

(Continued)

OTHER PUBLICATIONS

Northern Tool+Equipment, Ironton Drywall & Panel Hoist—150-Lb. Capacity, 11 Ft. Lift, Item# 23310,Jun. 30, 2017, pp. 1-2, USA.

*Primary Examiner* — Lynn E Schwenning
(74) *Attorney, Agent, or Firm* — Brunet & Co. Ltd.

(57) ABSTRACT

A hand-held tool for supporting a horizontally-oriented panel, e.g. drywall, while installing the panel on a ceiling is provided. The tool has a gripping region, a plurality of spaced-apart elongated panel supports, a plurality of spaced-apart struts connecting the gripping region to the panel supports, and a holder configured to releasably retain fasteners for installing the panel of the ceiling. The tool is portable, easy to manage and quick to use.

20 Claims, 11 Drawing Sheets

(56) References Cited

U.S. PATENT DOCUMENTS

| | | | | |
|---|---|---|---|---|
| 5,979,584 | A | 11/1999 | Lundgren | |
| 6,155,764 | A * | 12/2000 | Russo | A41D 13/0007 224/221 |
| 6,729,088 | B2 | 5/2004 | Corr | |
| 7,387,293 | B2 * | 6/2008 | Boucher | E04F 21/1894 254/120 |
| 7,594,456 | B2 * | 9/2009 | Hauber | B65D 73/02 206/347 |
| 8,336,835 | B1 | 12/2012 | Benner | |
| 8,469,427 | B1 * | 6/2013 | Mejia | B66F 19/00 294/209 |
| 2004/0065709 | A1 * | 4/2004 | Dillenberger | A45F 5/02 224/682 |
| 2004/0156698 | A1 * | 8/2004 | Mingoes | E04F 21/1811 414/10 |
| 2005/0188808 | A1 * | 9/2005 | Parrish | B26D 7/015 83/522.11 |
| 2006/0104735 | A1 * | 5/2006 | Zeiler | B25F 5/021 408/241 R |
| 2007/0138310 | A1 * | 6/2007 | Magnani | B25C 3/00 238/1 |
| 2012/0025550 | A1 * | 2/2012 | Gonzalez Sanchez | B65G 7/12 294/15 |
| 2014/0053498 | A1 | 2/2014 | Gonzalez | |

* cited by examiner

PANEL INSTALLATION APPARTUS

CROSS-REFERENCE TO RELATED APPLICATIONS

This application claims the benefit of United States Provisional application U.S. Ser. No. 62/545,961 filed Aug. 15, 2017, the entire contents of which is herein incorporated by reference.

FIELD

This application relates to building construction, particularly to implements for finishing work on buildings, more particularly implements to help set ceiling panels, such as drywall, on a ceiling.

BACKGROUND

The conventional method of installing a panel (e.g. drywall) on a ceiling involves standing on a box or bench, lifting the panel with both hands to position the panel on the ceiling, and then holding the panel against the ceiling with one hand. During the lifting of the panel, the drill is held either between a worker's legs or clipped to a tool belt. A screw is placed in a magnetic bit of a drill and the panel is screwed to the ceiling. More screws are held in the installers mouth, in the hand holding up the panel or in the tool belt. The installer places the drill between his knees, removes a screw from the mouth, the hand holding up the panel or the tool belt, installs it on the bit, and inserts subsequent screws to tack the panel in place on the ceiling. The process is time consuming, difficult and dangerous due to the danger of ingesting the screws, the danger of screws piercing the hand holding up the panel and the need to stand on a support structure. Holding up the panel on the ceiling with one hand is also painful due to the weight of the panel on the worker's fingers and the position of the wrist while holding the panel up for an extended period of time.

Many efforts in the art have been made to ameliorate this problem by using floor supported supports for lifting and/or supporting panels for installation on a ceiling. However, such floor supported supports are generally more expensive, laborious to use, require much time to set up, and/or are more difficult to transport and store due to their size and complexity.

There remains a need for a simple, hand-held tool for assisting in the installation of ceiling and wall panels, which is portable, easy to manage and quick to use.

SUMMARY

A hand-held tool for supporting a substantially horizontally- or vertically oriented panel while installing the panel on a ceiling or a wall is provided. In one aspect, the tool comprises: a plurality of spaced-apart elongated panel supports; a handle, the handle comprising a gripping region and a plurality of spaced-apart struts connecting the gripping region to the panel supports; and, a holder configured to releasably retain fasteners for installing the panel on the ceiling or the wall.

The hand-held tool comprises a handle and a plurality of spaced-apart elongated panel supports attached to the handle. The handle comprises a gripping region and a plurality of spaced apart struts connecting the gripping region to the panel supports. The handle and panel supports may comprise elongated structures, for example solid and/or hollow tubes, which are connected together as monolithic pieces and/or as separate but attached pieces. The plurality of spaced-apart elongated panel supports may be oriented longitudinally in a first plane. The gripping region may be oriented longitudinally in a second plane. The first plane may be parallel to but spaced apart from the second plane. The plurality of spaced apart struts may be oriented longitudinally in a third plane. The third plane may be oriented in a non-zero angle, preferably orthogonally, with respect to the first and second planes. In one embodiment, the plurality of spaced-apart elongated panel supports may comprise a first set of spaced-apart substantially parallel tubes oriented substantially orthogonally to the gripping region in a plane substantially parallel to but spaced apart from a plane in which the gripping region is oriented. In one embodiment, the plurality of spaced apart struts may comprise a second set of spaced-apart parallel tubes oriented substantially orthogonally to the gripping region in a plane substantially orthogonal to the plane in which the gripping region is oriented and substantially orthogonal to the plane in which the first set of substantially parallel tubes is oriented. The plurality of spaced-apart elongated panel supports may comprise two, three, four, five or more supports, for example two spaced-apart elongated panel supports. The plurality of spaced apart struts may comprise two, three, four, five or more struts, for example two spaced-apart struts.

In one embodiment, the gripping region may comprise a hand grip. The hand grip may comprise any suitable material, for example a polymer (e.g. rubber, thermoplastic) or cloth, that is comfortable to hold and that reduces the chance that the tool could slip out of a worker's grasp. The hand grip may comprise surface features such as undulations to further provide a suitable gripping surface.

In one embodiment, the plurality of spaced-apart struts may be extendible. Extendible struts permit holding the panel against a higher ceiling without the need to stand on a box, bench, ladder or other similar structure to comfortably install the panel on the ceiling without the worker overreaching. The extendible struts may comprise a tube-in-tube arrangement, a screw arrangement, sliding stacked beams, or any other arrangement that permits extending the length of the struts. In one embodiment, the extendible struts may comprise telescoping tubes, the telescoping tubes comprising a first tube slidable within a second tube. The telescoping tubes may comprise two, three, four or more telescoping tubes, for example three nested tubes including an inner tube that slides within a middle tube, the middle tube sliding within an outer tube. The extendible struts may further comprise locks to lock the struts in place, for example when the struts are fully extended and/or retracted, especially when the struts are fully extended. Locking the locks prevents extension and/or retraction of the struts, while unlocking the locks permits extension and/or retraction of the struts. The locks may comprise any suitable locking mechanism, for example latches in catches, pins and apertures, threaded bosses with mated threads and the like. In one embodiment, the locks may comprise spring-loaded pins mounted on sides of inside struts, which engage corresponding apertures in sides of outside struts. The spring-loaded pins snap into place in the apertures when the pins align with the apertures thereby locking the struts in place. Depressing the spring-loaded pins permits the struts to slide once again.

The plurality of spaced-apart elongated panel supports may comprise panel support regions, which engage the panel to support the panel either horizontally or vertically. The panel support regions may comprise panel interface surfaces configured to support the panel in a horizontal orientation for installation on the ceiling. The panel interface surfaces engage a facing surface of the panel. The panel interface surfaces may comprise pads which do not blemish or otherwise damage the panel when in contact with the panel. The pads may comprise non-scuff pads, which comprise a material, for example plastic or cloth, which does not blemish or otherwise damage the facing surface of the panel. The panel support regions may comprise a panel edge engagement surface configured to support the panel in a vertical orientation for installation on the wall. The panel edge engagement surface may comprise an elongated indent in one or more of the elongated panel supports.

The holder releasably retains fasteners in a convenient location so that a worker with the hand-held tool in one hand and a drill or other tool (e.g. a screwdriver, hammer and the like) does not need to put the drill or other tool down or hold fasteners in his or her mouth, other hand or tool belt to connect the fastener to the drill or other tool. In one embodiment, the holder may comprise a strip of material having apertures through which the fasteners can be inserted to secure the fasteners in the strip. The apertures may be lined with flexible casings or be provided with flexible gates to provide structures that hold the fasteners in the apertures. The holder may be reusable or non-reusable. In one embodiment of a non-reusable holder, a strip of material may be provided with a plurality of apertures having flexible gates through which the fasteners are pre-loaded, whereby removing the fasteners damages the gates rendering the holder non-reusable. In one embodiment of a reusable holder, a strip of material may be provided with a plurality of paired apertures. The paired apertures may comprise first and second apertures, the first and second apertures connected by slots in the strip through which the fasteners can pass between the first and second apertures when the fasteners are in the holder. The first apertures may be configured to securely hold the fasteners to prevent the fasteners from falling out of the holder when the tool is supporting the panel, for example when the tool is held upside down. Flexible casings lining inner edges of the first apertures may serve to secure the fasteners in the first apertures. The second apertures may be configured to permit removal of the fasteners from the holder when the tool is supporting the panel, for example when the tool is held upside down. The second apertures may comprise tapered inner walls to prevent the fasteners from being pushed through to the other side of the strip when the fasteners are in the second apertures. To remove the fasteners from the reusable holder, the fastener may be slid laterally though the slot from the first aperture to the second aperture and then pulled out vertically from the second aperture. To replace the fasteners in the reusable holder, the fasteners may be pushed vertically into the second apertures and then slid laterally through the slot into the first apertures where the fastener is secured by the flexible casing. The fasteners may comprise a fastener useful for securing the panel to the ceiling or wall. Some examples of fasteners include screws (e.g. drywall screws), nails, bolts and the like.

The hand-held tool may comprise a retainer configured to mount the tool on a belt of a worker. The retainer may comprise a clipping arrangement, for example a clip attached to the tool, the clip having hooks that hook over the belt. In another embodiment, the clipping arrangement may comprise first and second mated structures, the first mated structure mounted on and/or integrated in the tool and the second mated structure mounted on and/or integrated in the belt. In one embodiment of mated structures, the tool may be provided with apertures that are mated with corresponding pegs mounted on a clip, the clip attachable to or integrated with the belt. Insertion of pegs into the apertures secures the tool to the belt. In another embodiment of mated structures, the tool may be provided with a magnet mounted on or in one or more of the elongated panel supports mated with a corresponding magnetically attractive material (e.g. another magnet or a ferromagnetic material such as steel, iron and the like) located on a clip, the clip attachable to or integrated with the belt. The clip may have a hook for supporting the clip on the belt of the worker. At least a portion of the clip may comprise the material that is magnetically attracted to the magnet of the tool. The material that is magnetically attracted to the magnet may be positioned to be able to magnetically attach to the magnet to retain the tool on the clip.

The hand-held tool may comprise a laser guiding system for guiding cutting of the panel. The laser guiding system may be located at any suitable location on the tool. The laser guiding system may be conveniently mounted in or on one or more of the elongated panel supports. The laser guiding system may be oriented to project a visible line of laser light on a facing surface of the panel. The visible line of laser light may be projected on the facing surface of the panel when the tool is hung from an upper edge of the panel when the panel is vertically oriented. The visible line of laser light may be projected on the facing surface of the panel when the tool is rested placed on the facing surface of the panel when the panel is horizontally oriented.

The hand-held may also comprise one or more lights to illuminate parts of the tool or a work area. For example, one or more lights may be employed to illuminate the holder to assist the worker in retrieving fasteners from the holder.

The panel may be any type of panel typically found in building construction including, for example, drywall (e.g. SHEETROCK), wallboard, wood panels (e.g. plywood, decorative paneling), siding and the like. The tool is particularly suited for drywall.

Further features of the tool may include extendible (e.g. telescoping) struts to adjust the length of the tool, drywall-safe material on panel supports to protect the drywall during installation and a clip for hanging the tool on a belt.

Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example, with reference to the accompanying drawings, in which.

DETAILED DESCRIPTION

Figure 1:
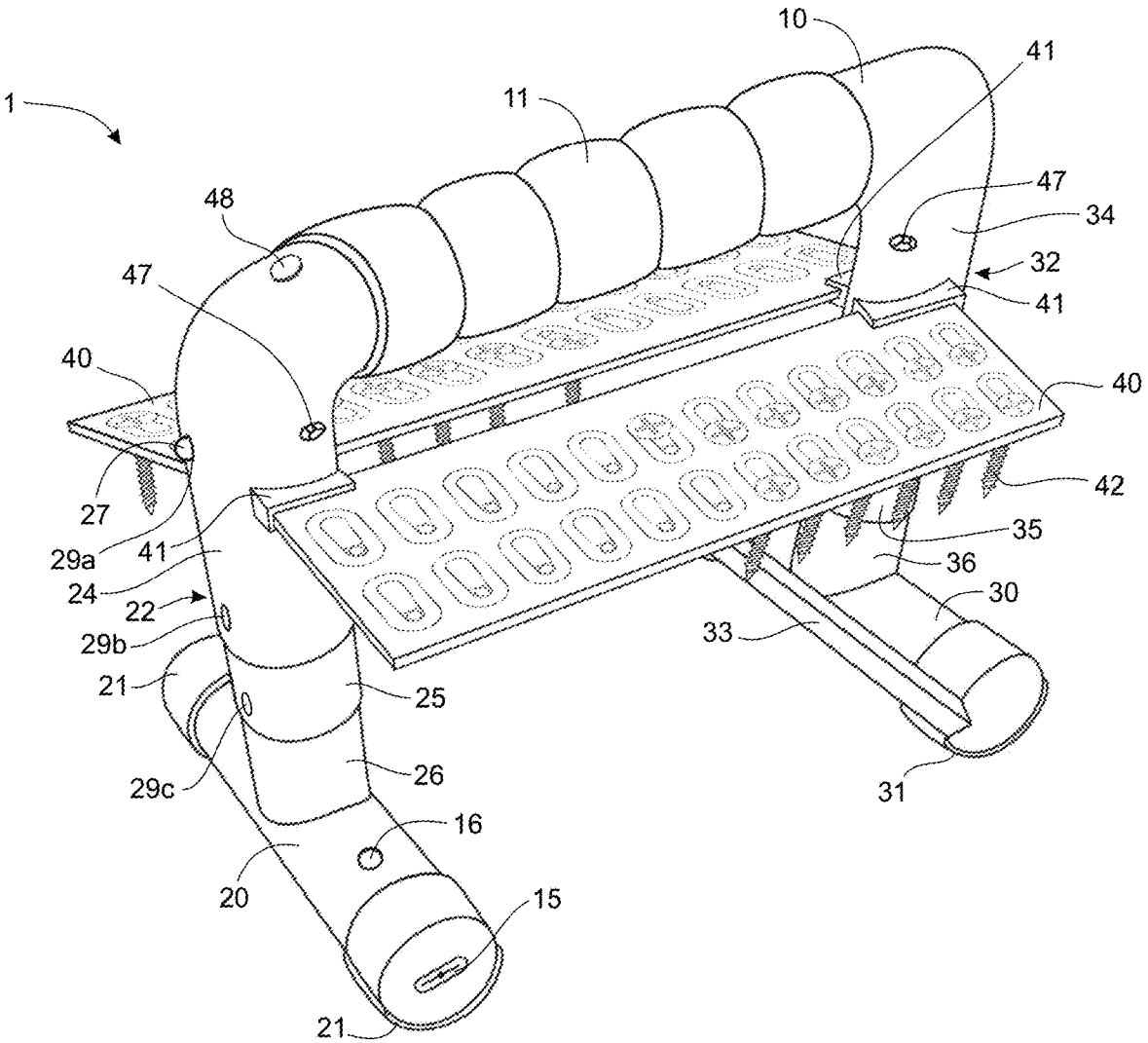
FIG. 1 is a perspective view of a hand-held tool for supporting a panel while installing the panel on a ceiling or a wall.
Figure 2:
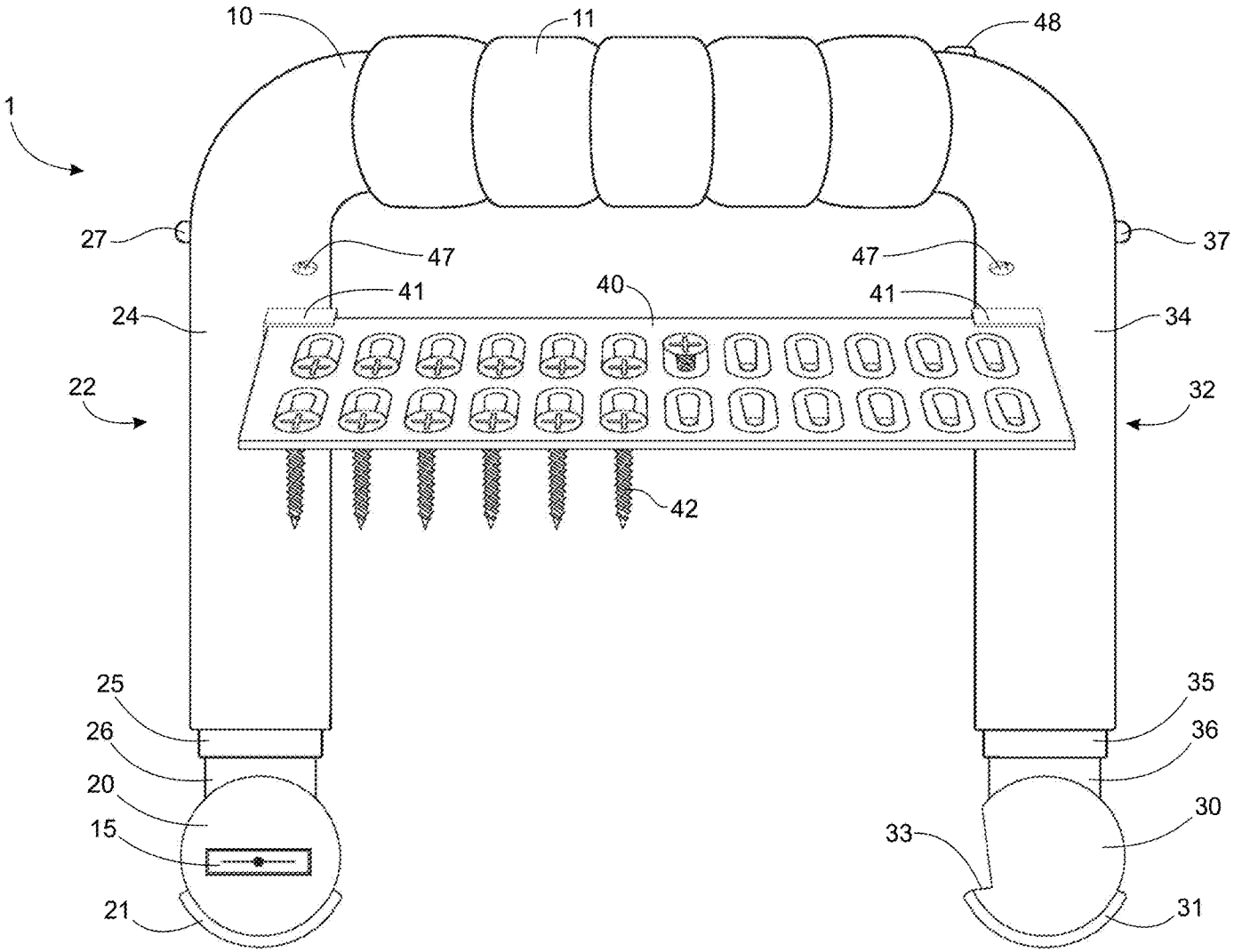
FIG. 2 is a side view of the tool of FIG. 1.

Referring to FIG. 1 to FIG. 13, a hand-held tool 1 of the present invention comprises a first elongated foot 20 and a second elongated foot 30, the feet 20, 30 comprising spaced-apart substantially parallel tubes, which engage a sheet of drywall 60, or other type of panel, for example a sheet of sheetrock, a sheet of wall board, a wood panel (e.g. a sheet of plywood or decorative paneling) or the like. While two substantially parallel feet are shown, the tool may comprise more than two feet, for example 3, 4, 5 or more feet, and the feet need not be substantially parallel. While cylindrical tubes are illustrated, the feet may be an elongated structure of any cross-sectional shape, and may be hollow or solid. The first foot 20 comprise two non-scuff pads 21 having contact surfaces, which are in contact with the sheet of drywall 60, or other type of panel, when the tool 1 is used to support the sheet of drywall 60, or other type of panel, horizontally for installation on a ceiling 61 (see FIG. 10A and FIG. 10B). Likewise, the second foot 30 comprise two non-scuff pads 31 having contact surfaces, which are in contact with a sheet of drywall 60, or other type of panel, when the tool 1 is used to support the sheet of drywall 60, or other type of panel, horizontally for installation on a ceiling 61 (see FIG. 10A and FIG. 10B). The non-scuff pads 21, 31 may comprise a material, for example plastic or cloth, that does not damage the sheet of drywall 60 when the pads 21, 31 contact the sheet of drywall 60. The contact surfaces of the pads 21, 31 are preferably co-planar, a plane formed by the contact surfaces being parallel to the ceiling 61 when the tool 1 is being used to support the sheet of drywall 60 on the ceiling 61 during installation. The feet 20, 30 are preferably longitudinally oriented parallel to the plane formed by the contact surfaces.

Figure 11:
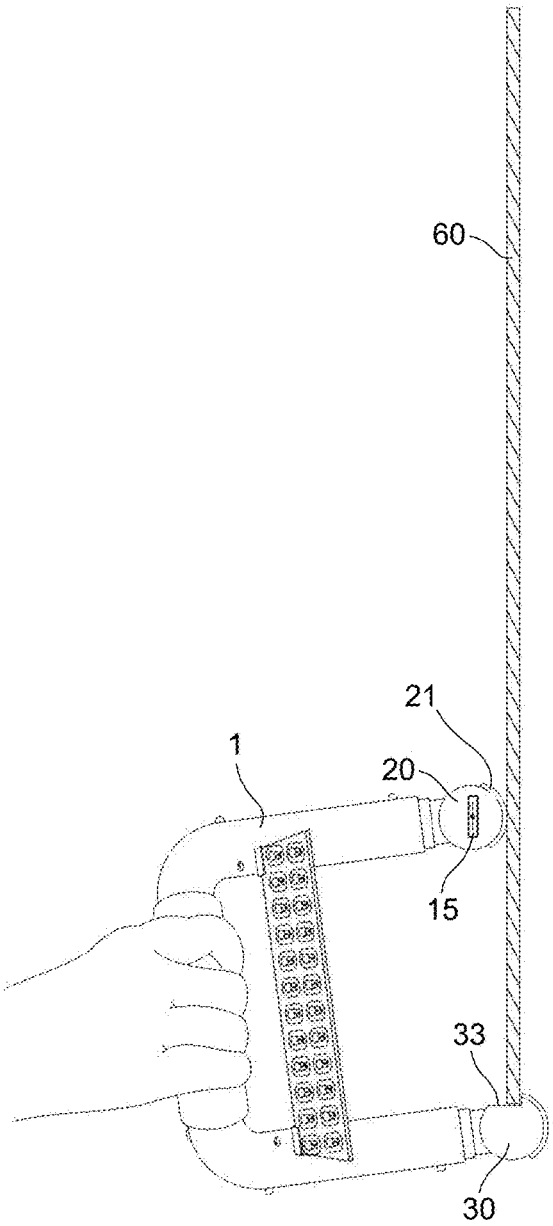
FIG. 11 depicts a use of the tool of FIG. 1 to support a sheet of drywall in a vertical orientation.

The second foot 30 further comprises an elongated indent 33 extending longitudinally along a full length of an inside of the second foot 30. The indent 33 may be L-shaped in cross-section, or have any other appropriate cross-sectional shape, to support an edge of the sheet of drywall 60 when the sheet of drywall 60 is vertically oriented for installation on a wall (FIG. 11). When used in this manner to support a sheet of drywall 60 for installation on a wall, the pad 21 of the first foot 20 engages a facing surface of the sheet of drywall 60. If desired, both feet may comprise such elongated indents.

The hand-held tool 1 further comprises a first leg 22 and a second leg 32 connected to the first foot 20 and the second foot 30, respectively. The legs 22, 32 comprise spaced-apart substantially parallel tubes. While two substantially parallel legs are shown, the tool may comprise more than two legs, for example 3, 4, 5 or more legs, and the legs need not be substantially parallel. While cylindrical hollow tubes are illustrated, the legs may be an elongated structure of any cross-sectional shape, and may be hollow or solid. Preferably, the tool comprises one leg for every foot. Longitudinal axes of the legs 22, 32 are substantially orthogonal to longitudinal axes of the feet 20, 30, the legs 22, 32 longitudinally oriented in a plane orthogonal to the plane formed by the contact surfaces of the pads 21, 31. The legs 22, 32 are substantially vertically oriented when the tool 1 is being used to support the sheet of drywall 60 on the ceiling 61 during installation, and substantially horizontally oriented when the tool 1 is being used to support the sheet of drywall 60 on the wall during installation.

Figures 3A, 3B, 3C:
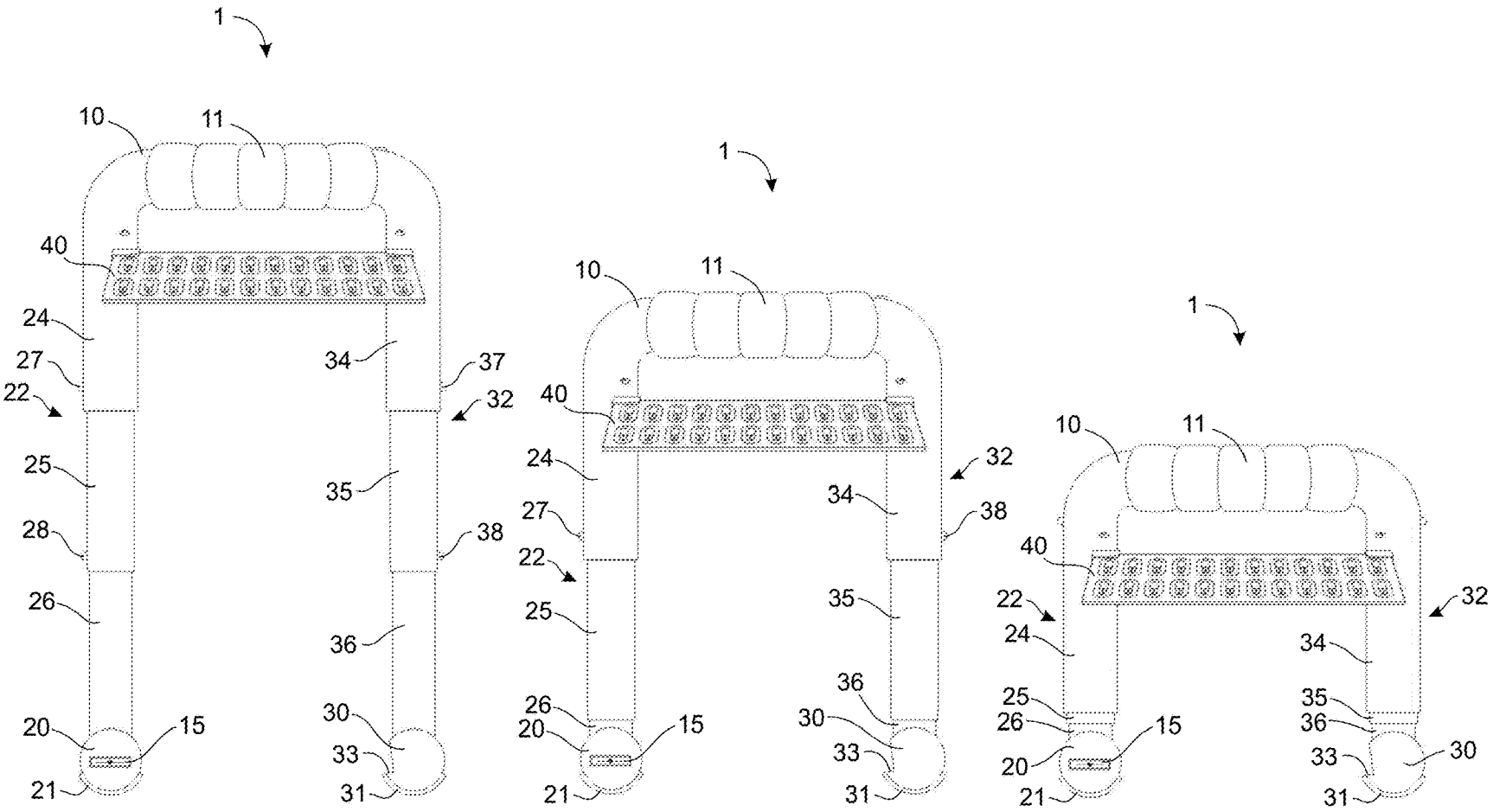
FIG. 3A is a side view of the tool of FIG. 1 fully extended.
FIG. 3B is a side view of the tool of FIG. 1 partially extended.
FIG. 3C is a side view of the tool of FIG. 1 fully retracted.

The first leg 22 comprises first, second and third leg portions 24, 25, 26, respectively, in a tube-in-tube arrangement. The third leg portion 26 comprises a tube that telescopes within the second leg portion 25, and the second leg portion 25 comprises a tube that telescopes within the first leg portion 24. Thus, the third leg portion 26 is an inner tube, the second leg portion 25 is a middle tube and the first leg portion 24 is an outer tube. As best seen in FIG. 3A, the middle tube (i.e. the second leg portion 25) comprises a spring-loaded pin 27, which can be engaged in a first pin aperture 29*a* in a side of the first leg portion 24 to lock the second leg portion 25 in a fully retracted position. Depressing the spring-loaded pin 27 permits sliding of the second leg portion 25 in the first leg portion 24 to extend the second leg portion 25, which locks into a fully extended position when the spring-loaded pin 27 aligns with a second pin aperture 29*b* in a side of the first leg portion 24. The inner tube (i.e. the third leg portion 26) also comprises a spring-loaded pin 28, which engages a third pin aperture 29*c* in the second leg portion 25 to lock the third leg portion 26 into a fully extended position when the third leg portion 26 is extended out of the second leg portion 25. Depressing the spring-loaded pin 28 permits sliding of the third leg portion 26 in the second leg portion 25 to return the third leg portion 26 to a fully retracted position. The second leg 32 is similar to the first leg 22, the second leg 32 comprising: first, second and third leg portions 34, 35, 36, respectively; a spring-loaded pin 37; and, a spring-loaded pin 38.

Figure 10A:
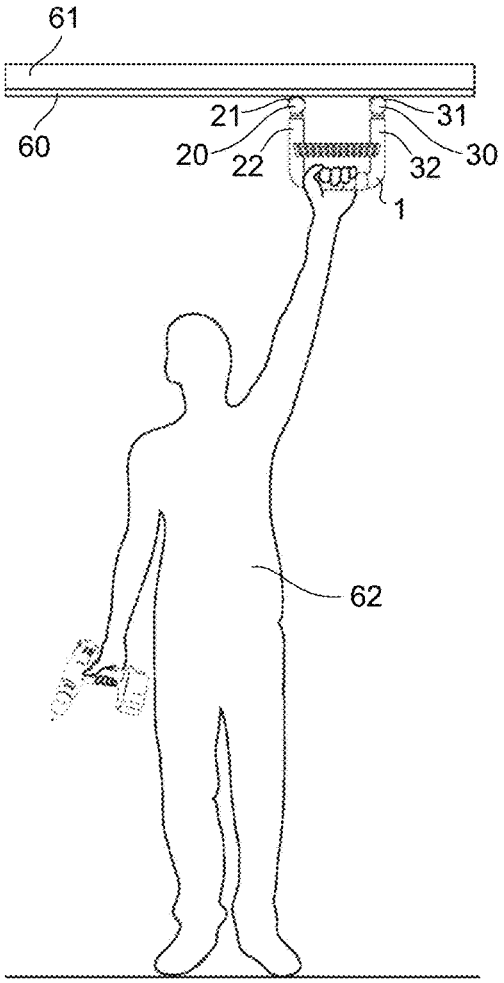
FIG. 10A depicts a worker using the fully retracted tool of FIG. 3C to support a sheet of drywall on an 8-ft high ceiling.
Figure 10B:
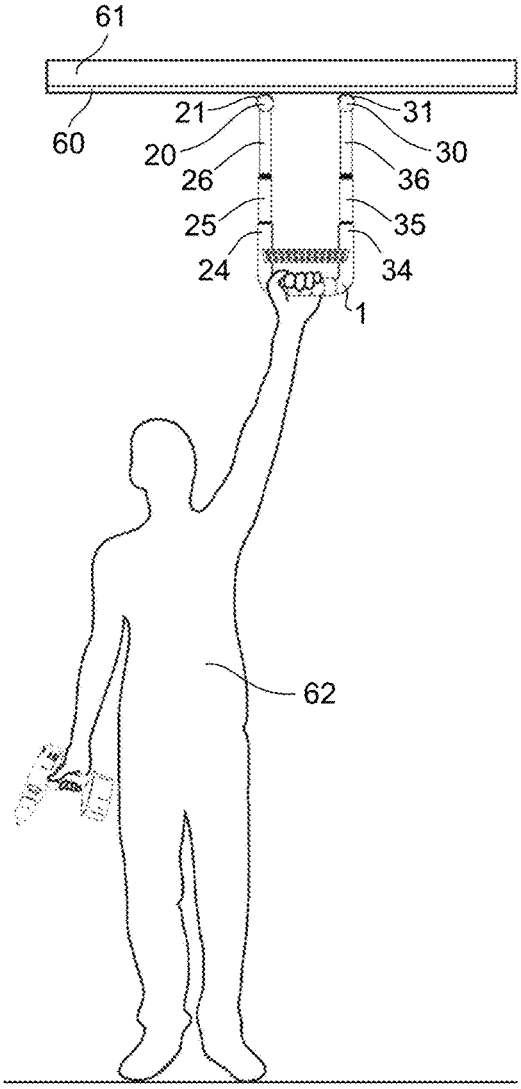
FIG. 10B depicts a worker using the fully extended tool of FIG. 3A to support a sheet of drywall on a 9-ft high ceiling.

Extension and retraction of the leg portions 24, 25, 26, 34, 35, 36 permit lengthening and shortening the hand-tool 1 to accommodate different heights of the ceiling 61, as seen in FIG. 10A and FIG. 10B. In this way, a worker 62 does not need to over-reach or stand on an object such as a stool, a box, a bench or another object to reach a desired ceiling height. Over-reaching or standing on such objects raises potential health and safety concerns, which the tool 1 reduces or eliminates altogether.

The hand-held tool 1 further comprises an elongated gripping portion 10, the gripping portion 10 comprising a hand grip 11. The hand grip 11 preferably comprises a material, for example rubber, which is comfortable to hold while providing sufficient friction to prevent the tool from slipping in a worker's hand, even a hand covered in perspiration. The gripping portion 10 connects the first leg 22 to the second leg 32. The gripping portion 10 is substantially orthogonal to the first and second legs 22, 32. However, the gripping portion could form some other angle with respect to the first and second legs. A longitudinal axis of the gripping portion 10 is parallel to the plane formed by the contact surfaces of the pads 21, 31. However, the gripping portion could form some other angle with respect to the plane formed by the contact surfaces of the pads. The gripping portion 10 together with the first and second legs 22, 32 form an extendible handle for the tool 1.

The hand-held tool 1 further comprises two screw plates 40 mounted on opposite sides of the gripping portion 10. While the screw plates may be mounted on the gripping portion, the first and second legs or the feet, the illustrated embodiment shows the screw plates 40 mounted on the first and second legs 22, 32. While two screw plates are illustrated, the tool may comprise 1, 2, 3, 4 or more screw plates. The screw plates are configured to retain screws 42, or any other fasteners (e.g. nails, bolts and the like) in a manner that is accessible for connection of the screws to a drill, screwdriver or the like during installation of the panel on the ceiling or wall. The screw plates may be mounted in any convenient fashion; however, the screw plates are preferably removably mounted to facilitate replacement of the screw plates. The tool 1 shows the screw plates 40 mounted edgewise in snap-in clips 41 mounted on the first leg portions 24, 34 of the first and second legs 22, 32, respectively. The screw plates 40 are readily removable from and insertable in the snap-in clips 41 for easy replacement of the screw plates 40.

Figure 4A:
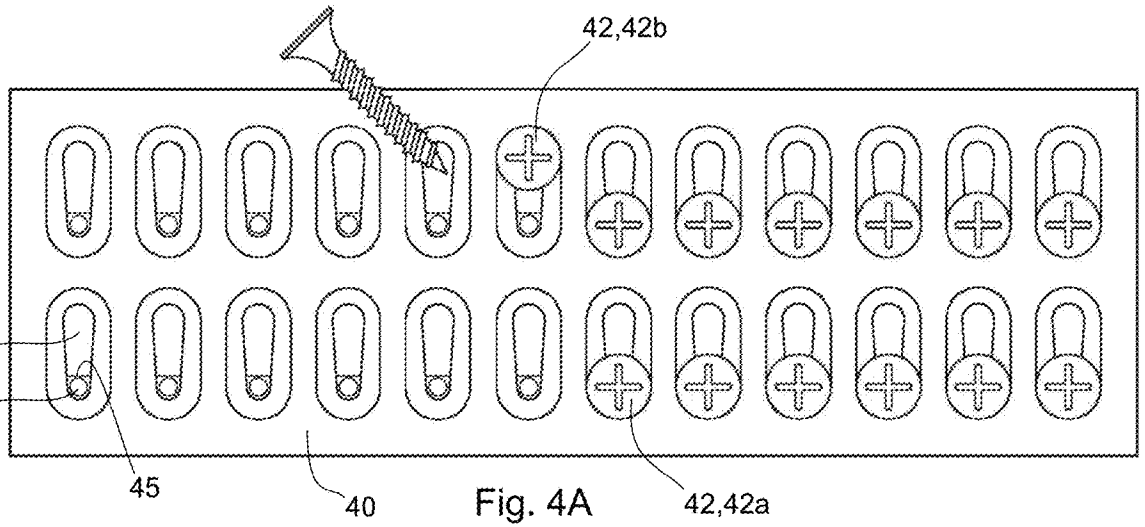
FIG. 4A is a top view of a first embodiment of a screw plate for the tool of FIG. 1.
Figure 4B:
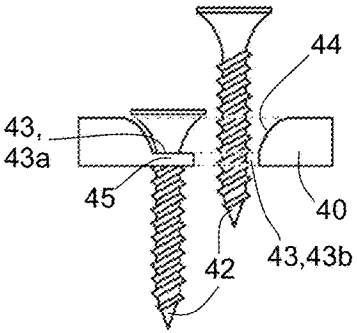
FIG. 4B is a side view of a screw in an aperture of the screw plate of FIG. 4A.

As particularly illustrated in FIG. 4A and FIG. 4B, the screw plate 40 is reusable, permitting extraction and replacement of the screws 42 in the screw plate 40. The screw plate 40 comprises a plurality of paired apertures 43 to hold the screws 42 therethrough. The paired apertures 43 (only one labeled) comprise first screw apertures 43*a* and second screw apertures 43*b*. The first screw apertures 43*a* are connected to the corresponding second screw apertures 43*b* by slots through which the screws 42 can pass between the first and second screw apertures 43*a*, 43*b* of a given pair of apertures 43. The first screw apertures 43*a* are holding apertures that securely hold the screws 42 (one particularly labeled as 42*a* in FIG. 4A) to prevent the screws 42 from falling out of the screw plate 40 when the tool 1 is held upside down supporting the sheet of drywall 60. Flexible casings 45 (only one labeled) of sufficiently small diameters perimetrically disposed around inner edges of the first screw apertures 43*a* secure the screws 42 in place. The flexible casings 45 may comprise any sufficiently flexible and durable material, for example, rubber or thermoplastic, which is suitable to hold the screws 42 in the first screw apertures 43*a*. The second screw apertures 43*b* are delivery apertures having a larger opening to permit easy removal of the screws 42 (one particularly labeled as 42*b* in FIG. 4A) from the screw plate 40, and having tapered inner walls 44 (see FIG. 4B) to prevent the screws 42 from being pushed through to the other side of the screw plate 40. Such a dual-aperture system permits the worker to connect a magnetic drill bit to the screws 42 while the screws 42 are in the first screw apertures 43*a*, then using the drill to slide the screws 42 though the slots to the second screw apertures 43*b*, and then to extract the screws 42 from the second screw apertures 43*b* by pulling the drill away from the screw plate 40. The tool 1 therefore allows the worker to use one hand to hold the tool 1 to support the sheet of drywall 60 in place on the ceiling 61, while the other hand is free to and capable of using the drill to load and use the screws 42 without releasing the tool 1 and without the worker needing to hold the drill between his or her knees and extract a screw from a different location to load the drill. The paired apertures 43 also permit reloading the screw plate 40 with more screws 42 by inserting the screws 42 into the second screw apertures 43*b* and then sliding the screws 42 over to the first screw apertures 43*a*. Depending on construction of the flexible casings 45, the screws 42 may be directly insertable into the first screw apertures 43*a*.

Figure 5A:
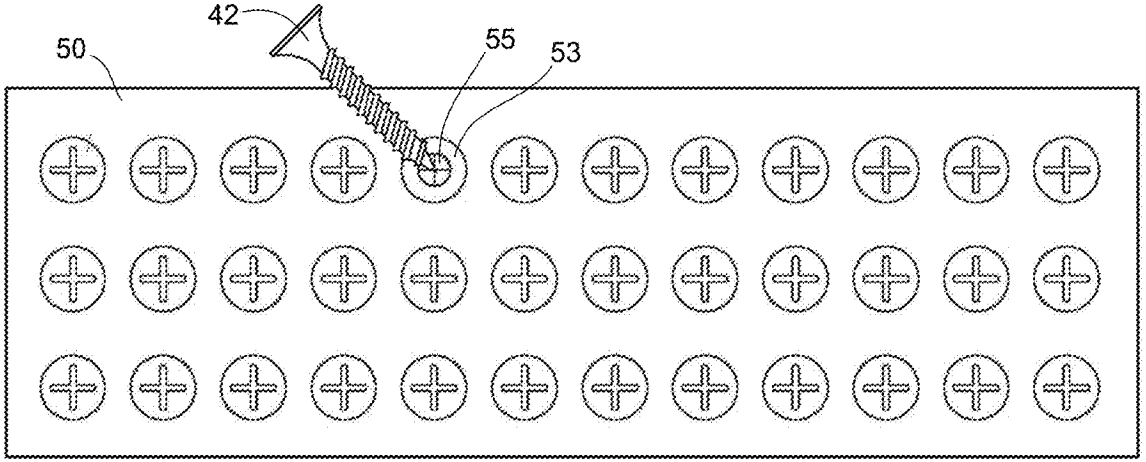
FIG. 5A is a top view of a second embodiment of a screw plate for the tool of FIG. 1.
Figure 5B:
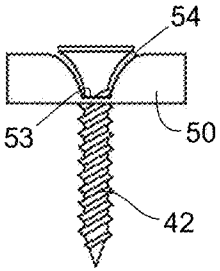
FIG. 5B is a side view of a screw in a paired aperture of the screw plate of FIG. 5A.

With reference to FIG. 5A and FIG. 5B, in a second embodiment, a non-reusable screw plate 50 may comprise a plurality of single screw apertures 53 (only one labeled) in which the screws 42 are pre-loaded. The screws 42 are secured in the screw apertures 53 by flexible gates 55 (only one labeled), and tapered inner walls 54 (see FIG. 5B) of the screw apertures 53 prevent the screws 42 from being pushed through to the other side of the screw plate 50. A magnetic drill bit of a drill may be engaged with heads of the screws 42 and the screws 42 pulled out of the screw plate 50. Pulling the screws 42 out of the screw apertures 53 may damage the flexible gates 55 rendering the screw plate 50 non-reusable. In some cases, the flexible gates 55 may be sufficiently robust that simply pulling the screws 42 out of the screw plate 50 would be difficult. In such cases, brief activation of the drill while the screw 42 is engaged with the drill and is still in the aperture 53 could be done to spin the screw 42 inside the aperture 53, thereby breaking the gate 55 allowing the screw 42 to slide out.

Figure 6:
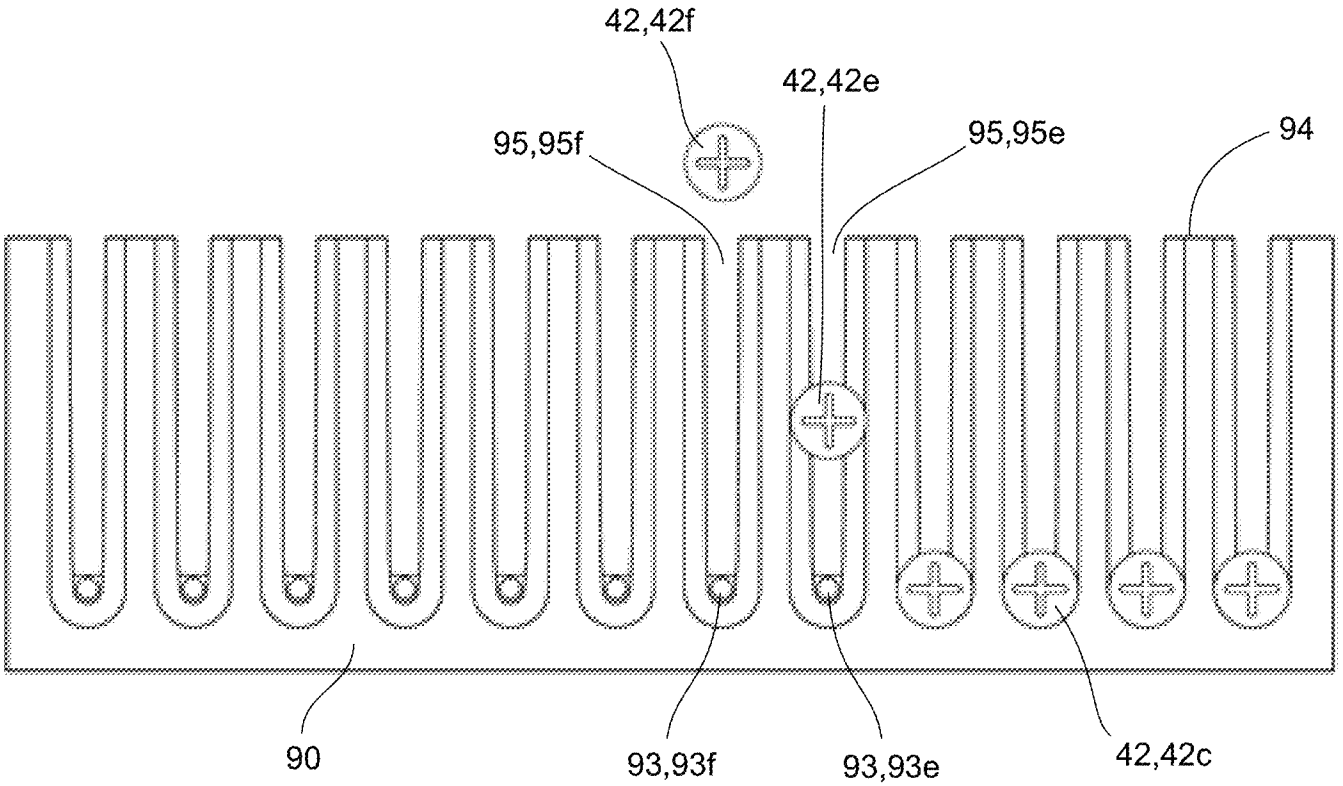
FIG. 6 is a top view of a third embodiment of a screw plate for the tool of FIG. 1.

With reference to FIG. 6, a third embodiment of a reusable screw plate 90 is similar to the screw plate 40 shown in FIG. 4A and FIG. 4B except that instead of paired apertures to hold and release screws, the screw plate 90 comprises a plurality of holding apertures 93 of the same construction as the first screw apertures 43*a* in FIG. 4A and FIG. 4B, the holding apertures 93 in open communication with an edge 94 of the screw plate 90 through corresponding slots 95 leading from the edge 94 to the respective holding apertures 93. Screws 42 may be loaded into the holding apertures 93 by sliding threaded bodies of the screws 42 through the slots 95 until the screws 42 are engages within the holding apertures 93. Screws 42 may be removed from the holding apertures 93 by sliding threaded bodies of the screws 42 from the holding apertures 93 through the slots 95 until the screws 42 are removed through the edge 94 of the screw plate 90. The particular screw 42*c* is shown engaged in one of the holding apertures in a manner similar to the screw 42*a* in FIG. 4A. The particular screw 42*e* is shown being slid through the corresponding slot 95*e*, either toward or away from the corresponding holding aperture 93*e*. The particular screw 42*f* is shown ready to be slid into or having just been slid out of the corresponding slot 95*f*. The screw plate 90 is reusable and permits easier loading and removal of the screws 42 in comparison to the screw plate 40 of FIG. 4A and FIG. 4B.

The hand-held tool 1 further comprises lights 47 that illuminate the screw plates 40 in a dark environment. The lights 47 may be LED lights, tungsten bulbs or the like. The lights 47 may be directional to illuminate the screw plates 40 without providing stray light that may be bothersome to a worker. A light switch 48 switches the lights 47 on and off. The light switch is preferably located on the gripping portion 10 outside the hand grip 11. The lights 47 are preferably located on the first leg portions 24, 34 of the first and second legs 22, 32.

Figure 12A:
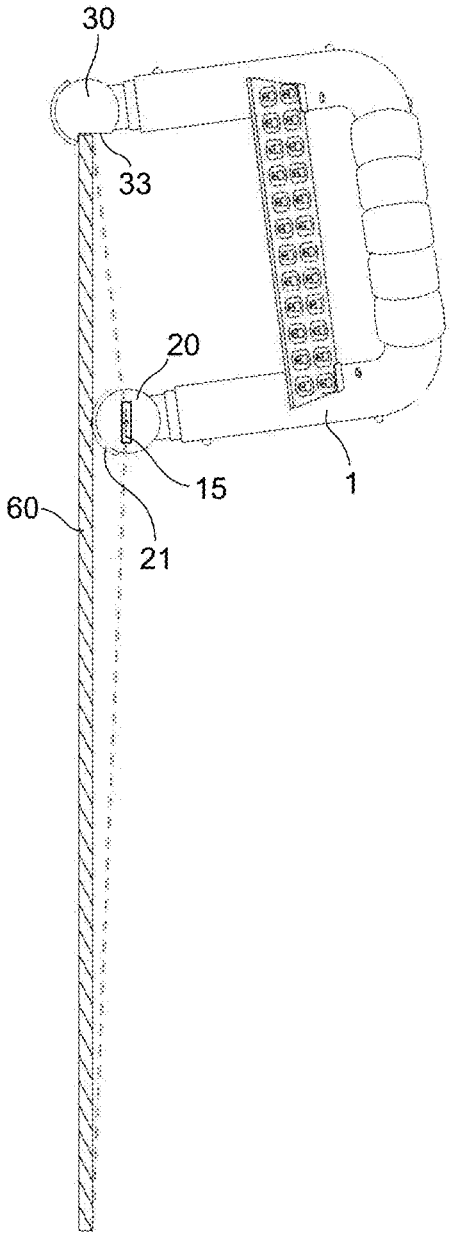
FIG. 12A depicts an end view of a vertically oriented sheet of drywall with the tool of FIG. 1 hanging vertically from a top edge thereof illustrating use of a laser guiding system of the tool to assist with cutting the sheet of drywall.
Figure 12B:
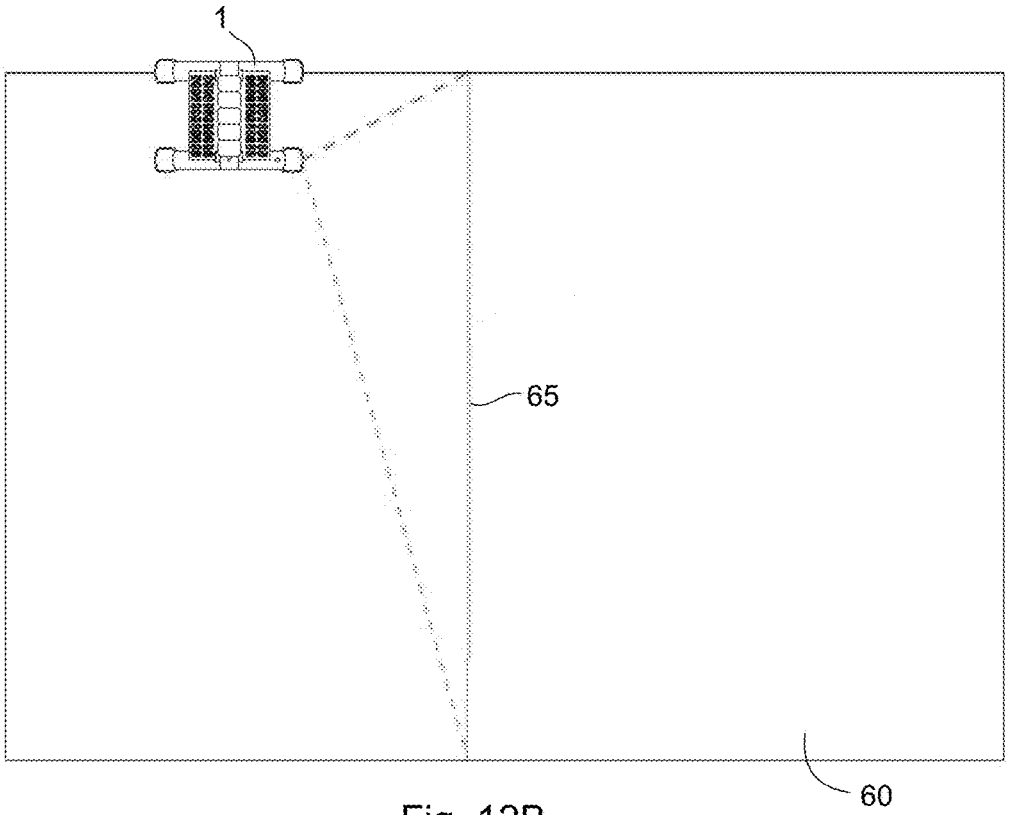
FIG. 12B depicts a side view of the sheet of drywall of FIG. 12A.
Figure 13:
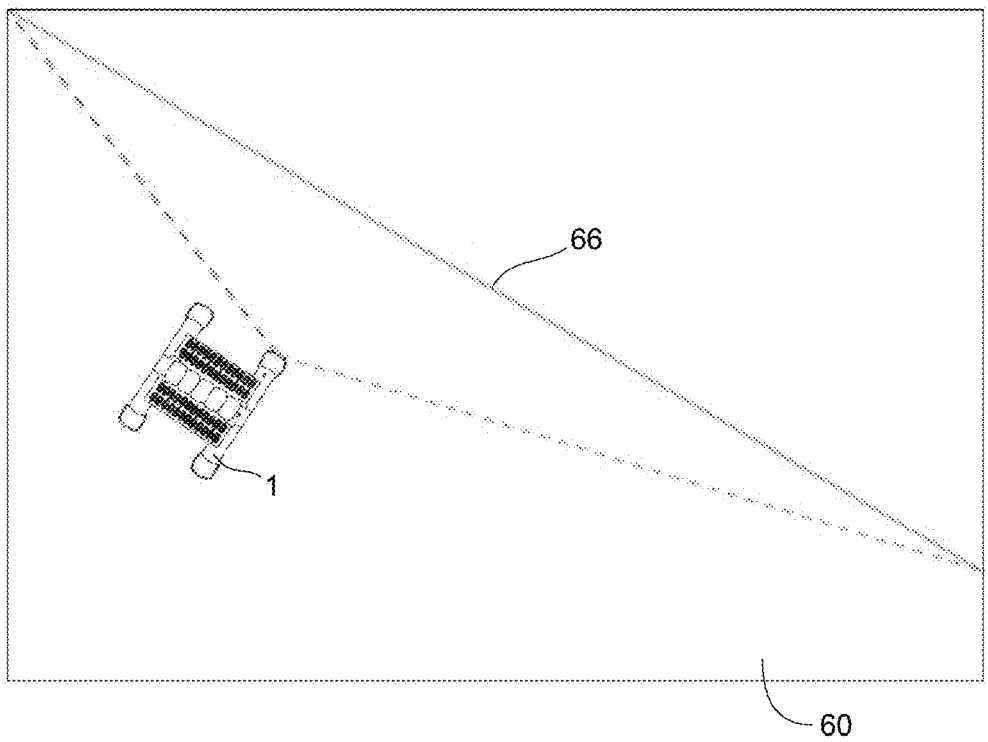
FIG. 13 depicts a top view of a horizontally oriented sheet of drywall with the tool of FIG. 1 placed thereon illustrating use of a laser guiding system of the tool to assist with cutting the sheet of drywall.

The hand-held tool 1 further comprises a horizontal laser guiding system 15 for assistance in cutting the sheet of drywall 60 to a desired length. The laser guiding system 15 is situated on an end of the first foot 20 and may be switched on and off with an on/off switch 16 located on the first foot 20. The laser guiding system may be located on any one or more ends of any one or more of the feet. The on/off switch may be located anywhere on the tool, although locating the on/off switch close to the laser guiding system is more efficient. The laser guiding system 15 may replace a traditional T-square, which is large and bulky and which may get bent over time or lost. Use of the laser guiding system 15 on the tool 1 is illustrated in FIG. 12A, FIG. 12B and FIG. 13. As shown in FIG. 12A and FIG. 12B, the tool 1 may be hung on an upper edge of a vertically oriented sheet of drywall 60 by resting the indent 33 in the second foot 30 on the upper edge of the sheet of drywall 60. In this configuration, the pad 21 of the first foot 20 engages the surface of the sheet of drywall 60, and the laser guiding system 15, when switched on, displays a straight line 65 on the facing surface of the sheet of drywall 60, which guides the worker when making a cut. As shown in FIG. 13, placing the tool 1 on a horizontally oriented sheet of drywall 60 and switching on the laser guiding system 15 displays a straight line 66 on the surface of the sheet of drywall 60, which guides the worker when making a cut.

Figure 7B:
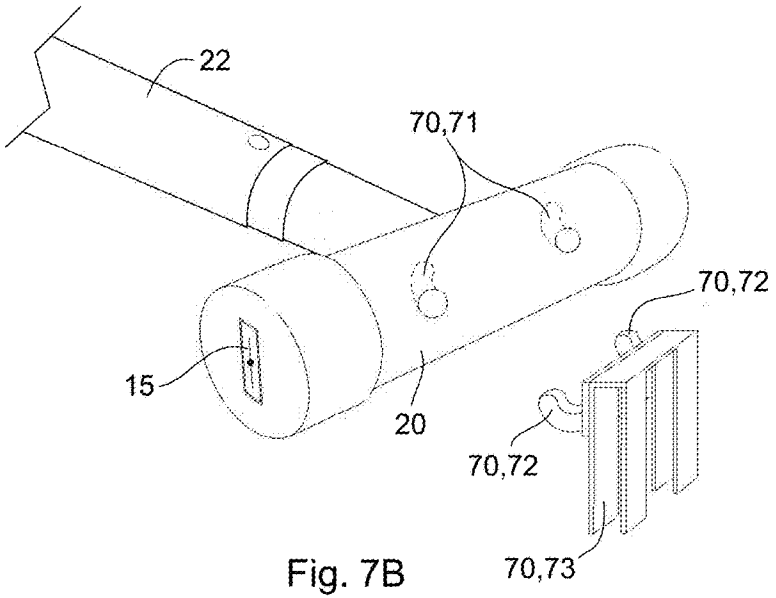
FIG. 7B is a perspective view of clip shown in FIG. 7A.
Figure 7A:
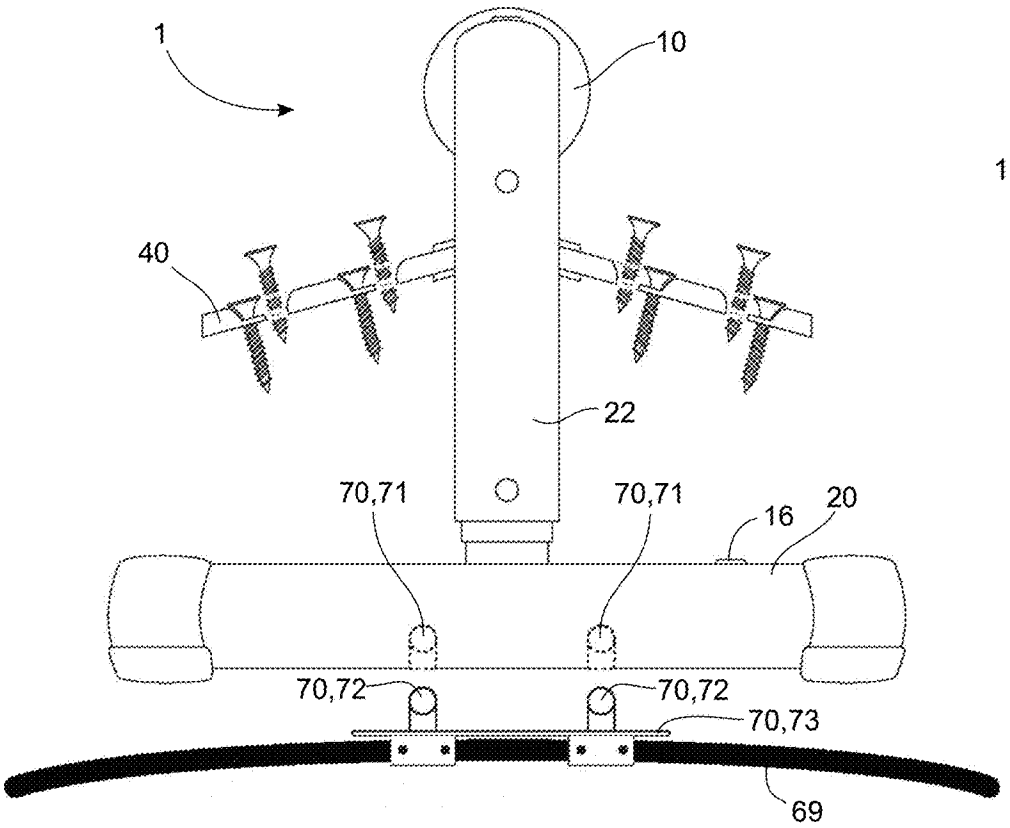
FIG. 7A is an end view of the tool of FIG. 1 showing a first embodiment of a clip for connecting the tool to a worker's belt.

The hand-held tool 1 may further comprise a toolbelt clip. In a first embodiment as illustrated in FIG. 7A and FIG. 7B, a tool belt clip 70 comprises two spaced-apart curved bore holes 71 in the first foot 20 mated with two curved pegs 72 mounted on a hook 73, which can be hooked over a toolbelt 69 worn by the worker. To secure the tool 1 to the toolbelt 69, the curved pegs 72 are inserted into the curved bore holes 71, the curvature of the pegs 72 and bore holes 71 preventing the tool 1 from slipping off the pegs 72. The hook 73 may be permanently attached to the toolbelt 69 if desired. While two bore holes and pegs are illustrated, there may be 1, 2, 3, 4 or more mated bore holes and pegs. The bore holes and pegs may be of any desired shape that allows for easy and secure connection between the hand-held tool and the worker's toolbelt. Either or both of the feet may comprise the bore holes. If the feet are hollow, simple apertures in the foot are sufficient to engage the pegs to secure the tool on the toolbelt.

Figure 8B:
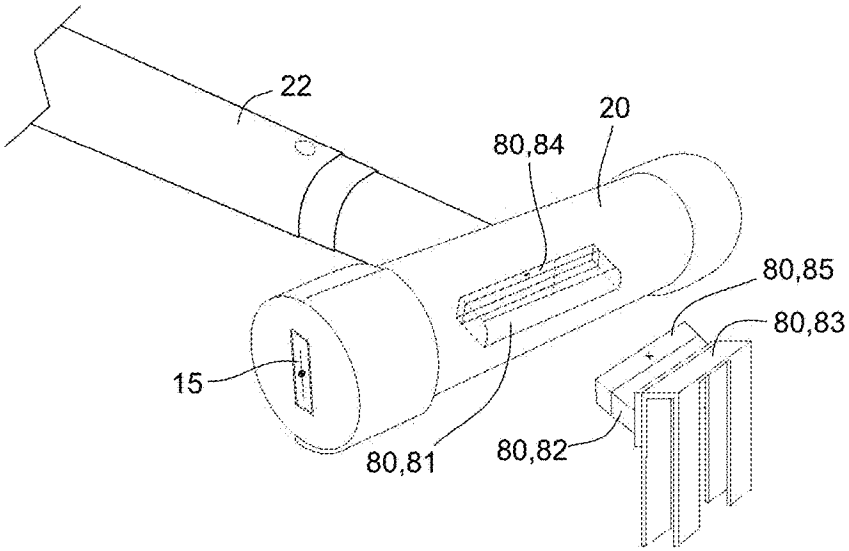
FIG. 8B is a perspective view of clip shown in FIG. 8A.
Figure 8A:
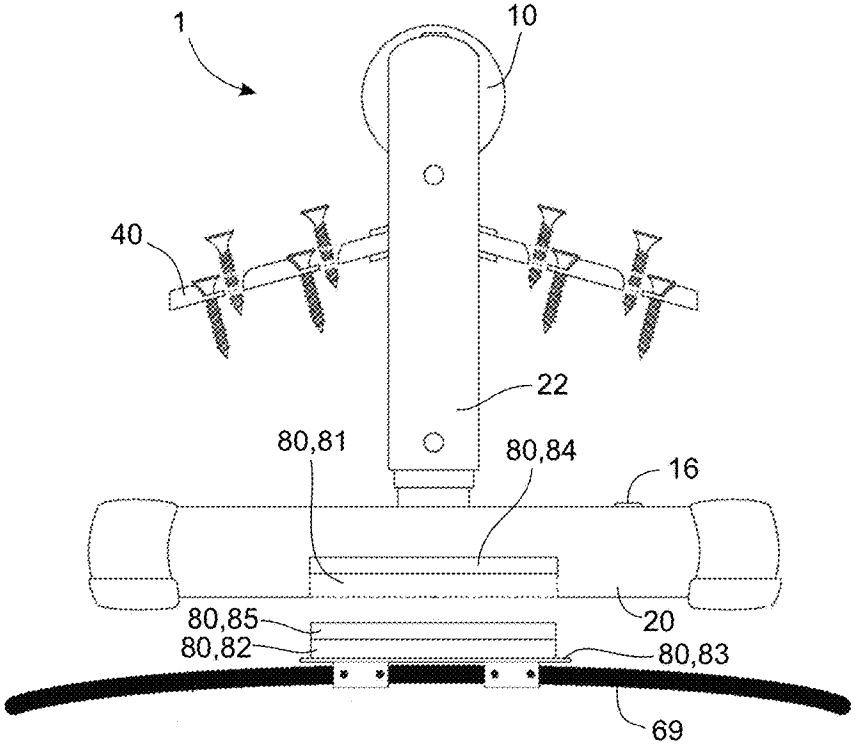
FIG. 8A is an end view of the tool of FIG. 1 showing a second embodiment of a clip for connecting the tool to a worker's belt.
Figure 9:
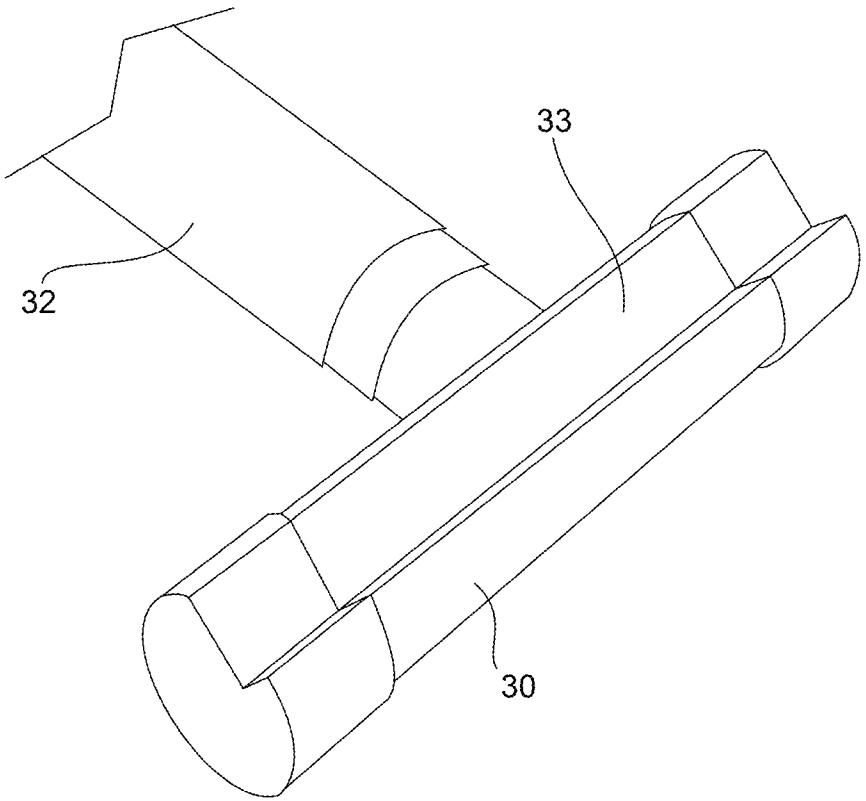
FIG. 9 is a perspective view of a supporting indent in a foot of the tool of FIG. 1.

In a second embodiment as illustrated in FIG. 8A and FIG. 8B, a tool belt clip 80 comprises a cavity 81 in the first foot 20, the cavity 81 having a first magnet 84 secured therein for magnetic engagement with a second magnet 85 secured to an insert 82 mated for insertion into the cavity 81. The insert 82 is mounted on a hook 83, which can be hooked over a toolbelt 69 worn by the worker. To secure the tool 1 to the toolbelt 69, the insert 82 is inserted into the cavity 81, where the first and second magnets 84, 85, respectively, magnetically engage thereby preventing the tool 1 from slipping off the insert 82. Instead of two magnets, only one magnet may be required, either in the foot or on the insert, the other magnet being replaced by a ferromagnetic material, for example a ferromagnetic metal such as steel. The hook 83 may be permanently attached to the toolbelt 69 if desired. Either or both of the feet may comprise the cavity. The use of magnets provides a quick and strong connection between the tool and the workbelt.

The novel features will become apparent to those of skill in the art upon examination of the description. It should be understood, however, that the scope of the claims should not be limited by the embodiments, but should be given the broadest interpretation consistent with the wording of the claims and the specification as a whole.

The invention claimed is:

1. A hand-held tool for supporting a panel while installing the panel on a ceiling or a wall, the tool comprising:

a plurality of spaced-apart elongated panel supports oriented longitudinally in a first plane;

a handle, the handle comprising a gripping region oriented longitudinally in a second plane and a plurality of spaced-apart struts oriented longitudinally in a third plane connecting the gripping region to the panel supports; and, a holder configured to releasably retain fasteners for installing the panel on the ceiling or the wall, the holder mounted on the handle or the panel supports, wherein the first plane is parallel to but spaced-apart from the second plane and the third plane oriented in a non-zero angle with respect to the first and second planes.

2. The tool of claim 1, wherein the holder comprises a strip of material having a plurality of paired apertures, the paired apertures comprising first and second apertures, the first and second apertures connected by slots in the strip through which the fasteners can pass between the first and second apertures when the fasteners are in the holder, the first apertures configured to securely hold the fasteners to prevent the fasteners from falling out of the holder when the tool is supporting the panel, and the second apertures configured to permit removal of the fasteners from the holder when the tool is supporting the panel.

3. The tool of claim 2, wherein the second apertures comprise tapered inner walls to prevent the fasteners from being pushed through to the other side of the strip when the fasteners are in the second apertures.

4. The tool of claim 2, wherein the first apertures comprise flexible casings perimetrically disposed around inner edges of the first apertures to secure the fasteners in the first apertures.

5. The tool of claim 1, wherein the fasteners comprise screws.

6. The tool of claim 1, wherein the plurality of spaced-apart elongated panel supports is two spaced-apart elongated panel supports, and the plurality of spaced-apart struts is two spaced-apart struts.

7. The tool of claim 1, wherein the gripping region comprises a hand grip.

8. The tool of claim 1, wherein the struts are extendible.

9. The tool of claim 8, wherein the extendible struts comprise telescoping tubes, the telescoping tubes comprising a first tube slidable within a second tube.

10. The tool of claim 9, wherein the telescoping tubes comprise a third tube, and the second tube is slidable within the third tube.

11. The tool of claim 8, wherein the extendible struts comprise locks, wherein locking the locks prevents extension and/or retraction of the struts, while unlocking the locks permits extension and/or retraction of the struts.

12. The tool of claim 1, further comprising a retainer configured to mount the tool on a belt of a worker.

13. The tool of claim 12, wherein the retainer comprises: a magnet mounted on or in one of the elongated panel supports; and, a clip having a hook for supporting the clip on the belt of the worker, at least a portion of the clip comprising a material magnetically attracted to the magnet and positioned to be able to magnetically attach to the magnet to retain the tool on the clip.

14. The tool of claim 1, wherein at least one of the elongated panel supports comprises an elongated indent configured to support the panel in a vertical orientation for installation on the wall.

15. The tool of claim 1, wherein the plurality of spaced-apart elongated panel supports comprise panel interface surfaces, the panel interface surfaces configured to support the panel in a horizontal orientation for installation on the ceiling, the panel interface surfaces comprising pads which do not blemish the panel when in contact with the panel.

16. The tool of claim 1, further comprising a laser guiding system for guiding cutting of the panel.

17. The tool of claim 16, wherein the laser guiding system is situated in one or more of the spaced-apart elongated panel supports, and wherein the laser guiding system is oriented to project a visible line of laser light on a facing surface of the panel when the tool is hung from an upper edge of the panel when the panel is vertically oriented or when the tool is rested placed on the facing surface of the panel when the panel is horizontally oriented.

18. The tool of claim 1, wherein the panel is drywall, wallboard or plywood.

19. A hand-held tool for supporting a panel while installing the panel on a ceiling or a wall, the tool comprising:

a plurality of spaced-apart elongated panel supports;

a handle, the handle comprising a gripping region and a plurality of spaced-apart struts connecting the gripping region to the panel supports; and, a holder configured to releasably retain fasteners for installing the panel on the ceiling or the wall, the holder mounted on the handle or the panel supports, wherein the plurality of spaced-apart elongated panel supports comprise a first set of spaced-apart substantially parallel tubes oriented substantially orthogonally to the gripping region in a plane substantially parallel to but spaced-apart from a plane in which the gripping region is oriented, and the plurality of spaced-apart struts comprise a second set of spaced-apart parallel tubes oriented substantially orthogonally to the gripping region in a plane substantially orthogonal to the plane in which the gripping region is oriented and substantially orthogonal to the plane in which the first set of substantially parallel tubes is oriented.

20. The tool of claim 19, wherein the gripping region comprises a hand grip, the struts are extendible and the extendible struts comprise locks, wherein locking the locks prevents extension and/or retraction of the struts, while unlocking the locks permits extension and/or retraction of the struts.

* * * * *